United States Patent [19]

Khoury

[11] 3,952,913

[45] Apr. 27, 1976

[54] TAB ANTI-ROTATION AND HOLD DOWN DEVICE

[75] Inventor: Nick S. Khoury, Worth, Ill.

[73] Assignee: Continental Can Company, Inc., New York, N.Y.

[22] Filed: Nov. 18, 1974

[21] Appl. No.: 524,681

[52] U.S. Cl. ..... 220/273
[51] Int. Cl.[2] ..... B65D 41/32
[58] Field of Search ..... 220/270–274

[56] References Cited

UNITED STATES PATENTS

| | | | |
|---|---|---|---|
| 3,724,709 | 4/1973 | Westphal | 220/273 |
| 3,869,063 | 3/1975 | Himstedt | 220/270 |

*Primary Examiner*—George T. Hall
*Attorney, Agent, or Firm*—John J. Kowalik; Joseph E. Kerwin; William A. Dittmann

[57] ABSTRACT

An improved pull tab mounting arrangement for an easy open end closure member, characterized by the provision of improved pull tab positioning means for maintaining the pull tab in a desired orientation relative to the panel-defining score line and minimizing tab protrusion from the end closure member. A depression is formed in the end panel and a pierced hole forming a protrusion with a jagged edge is incorporated in the tab nose portion above the depression, between the free extremity of the tab and the rivet means that secures the tab to the end panel member. The jagged protruding edge of the protrusion is driven into the base portion of the depression during the staking operation, thereby providing an anti-rotation interlock between the tab and the end panel. The depression serves as a detent positively restraining rotation of the tab and displacement of the nose relative to the score line. The protrusion, whose length exceeds the depth of the depression, further serves to raise the nose portion of the tab relative to the end panel thereby biasing the tab against the end panel upon staking of the rivet which forces the finger grip portion of the tab into close contact with the end panel.

1 Claim, 3 Drawing Figures

TAB ANTI-ROTATION AND HOLD DOWN DEVICE

SUMMARY OF THE INVENTION

The present invention relates to a new and useful improvement in an easy opening container and more particularly to a pull tab mounting arrangement for improving the opening characteristics thereof.

Easy opening containers of the general type to which the present invention relates include an end closure formed with a score line to define a removable panel portion for tilting movement so that a nose on one end of the tab initially severs the score line. Thereafter, a pulling force is applied on the pull tab to completely separate the removable panel portion along the score line from the end unit and thereby provide an opening in the end closure.

It is an object of the present invention to improve the opening characteristics of the pull tab to initiate the severance of the removable panel portion from the end unit.

This is accomplished by providing a mounting arrangement in which the pull tab nose is maintained in proper alignment with the score line. More specifically, the pull tab is mounted in a manner such that it is restrained against rotation to maintain the nose of the pull tab aligned with the score line so that upon initial tilting, the score line is severed by the tab nose.

It is another object to eliminate cleavage of the pull tab from the end member, thereby improving the appearance of the container and eliminating the possibility of accidental opening of the container during handling.

This is accomplished by providing a mounting arrangement which downwardly biases the finger grip portion of the tab. More specifically, the nose portion of the tab is maintained in spaced relation to the end panel thereby bowing or springing the tab toward the end panel during the staking operation and imparting a downward bias on the finger grip portion of the tab.

It is a primary object of the invention to provide an inexpensive, easily manufactured anti-rotation device on the tab which co-operates with a depression formed in the end panel and which is forced to dig into the end panel by the staking of the rivet which attaches the tab to the panel.

With the above and other objects in view that will hereinafter appear, the nature of the invention will be more understood by reference to the following description, the appended claims and the several views illustrated in the accompanying drawings.

DESCRIPTION OF THE PREFERRED EMBODIMENT

Figure 1:
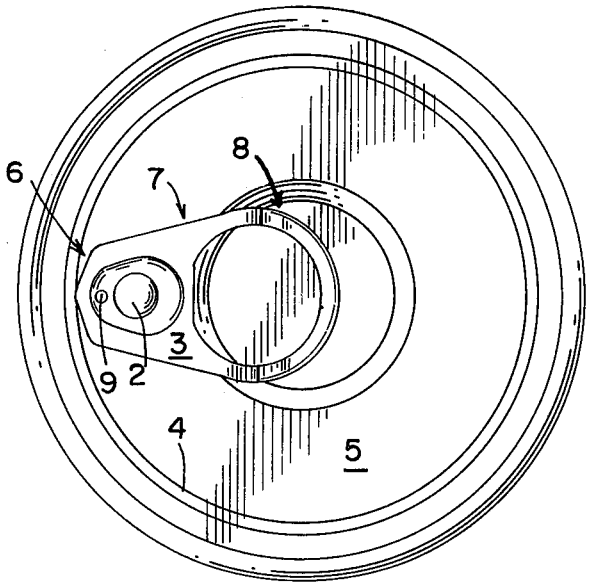
FIG. 1 is a top plane view of a can end closure incorporating the improved pull tab mounting arrangement of the present invention.
Figure 2:
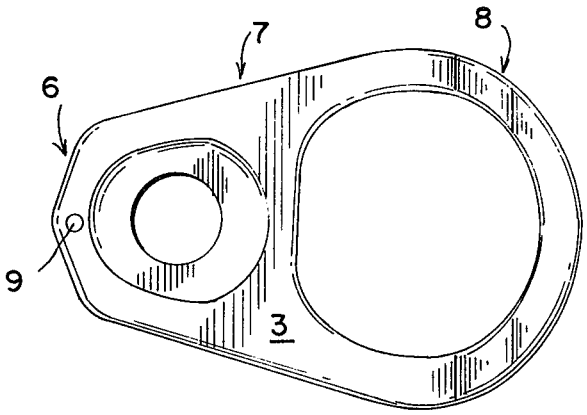
FIG. 2 is an enlarged top plan view of the tab.
Figure 3:
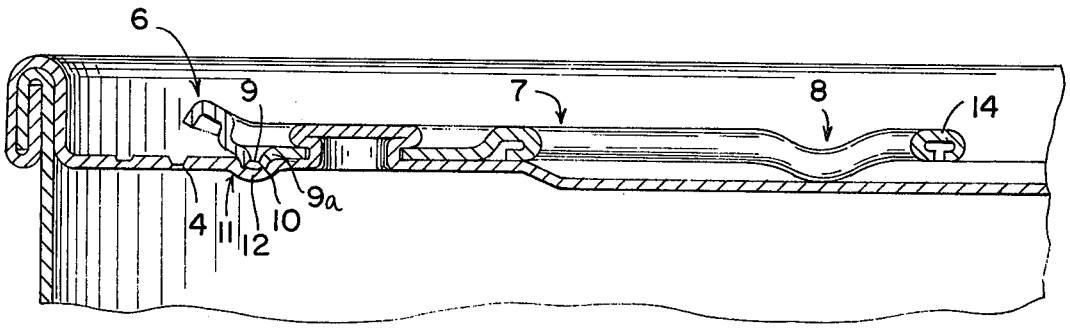
FIG. 3 is an enlarged fragmentary sectional view of the end closure, illustrating the manner in which the jagged protrusions on the tab dig into the base of a depression formed in the end panel.

In keeping with the present invention, there is provided an easy-open end closure comprising a metal end panel 1, a rivet 2 integrally formed in said end panel 1 and a metal pull tab 3 rotatably attached to said end panel 1 by said rivet 2. A score line 4 is formed in the end panel 1 and defines an opening flap 5 therein.

The tab 3 comprises a nose portion 6, an intermediate portion 7 and a finger grip portion 8. A hole 9 is pierced through a portion of the tab 3 and forms a jagged protrusion **9*a* with points 10 adjacent to the nose portion 6 between and in line with the free extremity of the tab 3 and the rivet means securing the tab 3 to the end panel 1. A peripheral rigidifying bead 14 encircles the tab 3 and facilitates removal of the flap 5**.

A depression 11 with base portion 12 is formed in the end panel 1 between and in line with the rivet 2 and the most immediately adjacent point on the score line 4, said depression lying beneath the hole 9 in the tab 3 when said tab 3 is attached to the end panel 1. The length of the protrusion **9*a* exceeds the depth of the depression 11**.

During the staking operation, wherein the tab 3 is fastened to the end panel 1, the tab 3 is forced downwardly onto the end panel 1, the jagged protrusion **9*a* being driven into the base portion 12 of the depression 11 whereby the points 10 engage the metal of the end panel 1, thereby preventing rotation of the tab 3 about the rivet 2 and maintaining the pull tab nose in proper alignment with the score line 4. In addition, the depression 11 serves as a detent, retaining the protrusion 9*a*** and further serving to prevent rotation.

The protrusion **9*a* further serves to raise the nose portion 6 relative to the end panel 1 and to maintain said portion 6 in spaced relation to said end panel 1. This spacing causes the tab 3 to become slightly bowed or sprung toward the end panel 1 when the intermediate portion 7 is fastened in close contact to the end panel 1 by the rivet 2. The resiliant, flexible tab 3 is thus subjected to a bending moment which downwardly biases both the finger grip portion 8 and the nose portion 6 and insures close contact is maintained between both of said portions and the end panel 1**.

I claim:

1. An improved pull tab mounting arrangement for an easy-open end closure member, said end closure member comprising an end panel, a pull tab, means attaching said tab to said end panel intermediate its ends, said tab having a nose portion at one end and a finger-grip portion at the other end, a score line formed in said end panel and defining an opening flap therein, the improvement comprising tang means on the nose portion for interlocking engagement of said tab and said end panel for holding the pull tab in opening association to said score line, and retention means formed in said end panel for retaining said tang means, said tang means comprising a panelwardly directed protrusion having sharp jagged points impaled into said retention means, said tang means holding said nose portion in spaced relation to said end panel and co-operating with said attaching means to panelwardly bias said finger-grip portion and hold the same against said end panel, said retention means comprising a recess formed in said end panel and having a base and said protrusion being impaled in said base.

* * * * *